US005432500A

United States Patent [19]

Scripps

[11] Patent Number: 5,432,500

[45] Date of Patent: Jul. 11, 1995

[54] OVERHEAD DETECTOR AND LIGHT ASSEMBLY WITH REMOTE CONTROL

[75] Inventor: Keith A. Scripps, Washington, D.C.

[73] Assignee: Scripps International, Ltd., Washington, D.C.

[21] Appl. No.: 140,495

[22] Filed: Oct. 25, 1993

[51] Int. Cl.[6] ..... G08B 17/10

[52] U.S. Cl. ..... 340/628; 340/538; 340/310.01

[58] Field of Search ..... 340/628, 527, 691, 693, 340/586, 538, 518, 333, 334, 310 R, 310 A, 309.15, 309.6, 310.01; 315/136; 367/197; 362/233, 272, 286

[56] References Cited

U.S. PATENT DOCUMENTS

| | | | |
|---|---|---|---|
| 3,818,466 | 6/1974 | Honda | 340/538 |
| 4,313,110 | 1/1982 | Subulak et al. | 340/527 |
| 4,383,251 | 5/1983 | Perelli et al. | 340/527 |
| 4,694,285 | 9/1987 | Scripps | 340/693 |
| 4,717,910 | 1/1988 | Scripps et al. | 340/693 |
| 4,737,769 | 4/1988 | Masot | 340/538 |
| 4,788,530 | 11/1988 | Bernier | 340/527 |
| 4,812,820 | 3/1989 | Chatwin | 340/518 |
| 4,812,821 | 3/1989 | Santy et al. | 340/533 |
| 4,812,827 | 3/1989 | Scripps | 340/693 |
| 4,814,748 | 3/1989 | Todd | 340/527 |
| 4,980,672 | 12/1990 | Murphy | 340/571 |
| 5,031,082 | 7/1991 | Bierend | 340/310 R |
| 5,072,216 | 12/1991 | Grange | 340/310 A |
| 5,093,651 | 3/1992 | Thomas | 340/628 |
| 5,186,653 | 2/1993 | Robert | 340/628 |
| 5,189,412 | 2/1993 | Mehta et al. | 340/310 A |

OTHER PUBLICATIONS

Radio Shack 1988 Catalog, No. 419, p. 117 "Infrared Security System With Dual-Floodlight Design".

*Primary Examiner*—John K. Peng
*Assistant Examiner*—Benjamin C. Lee
*Attorney, Agent, or Firm*—Sixbey, Friedman, Leedom & Ferguson

[57] ABSTRACT

The detector assembly is connectable to a power line which includes a switch which, when operated, causes power transitions at a power terminal for the detector assembly. The detector assembly includes a code responsive controller which operates in response to a plurality of power transitions occurring within a predetermined time period to deactivate a detector alarm for a determined delay period. The code responsive controller may also operate in response to different numbers of sensed power transitions to control the activation and deactivation of a light forming part of the detector assembly. A code transmitter responsive to the activation and deactivation of the detector alarm transmits an activation code and subsequently a deactivation code over the power line to activate and deactivate other detector assemblies, and a code receiver receives activation and deactivation codes from the power line and controls the activation and deactivation of the detector alarm in accordance therewith.

25 Claims, 4 Drawing Sheets

OVERHEAD DETECTOR AND LIGHT ASSEMBLY WITH REMOTE CONTROL

TECHNICAL FIELD

The present invention relates generally to alarm detectors for sensing the occurrence of a dangerous condition and providing an alarm in response thereto, and more particularly to an alarm detector which is connected to the conventional electrical wiring circuit of a building, such as by threaded reception in an overhead light socket, and which is remotely controlled by means of such electrical wiring circuit.

BACKGROUND OF THE INVENTION

Property loss, personal injury and loss of life due to fire can often be minimized or avoided when smoke or heat detectors are employed to provide an alarm during the initial stages of a fire. Consequently, local law in many jurisdictions requires that smoke and heat detectors with alarms be provided in public and commercial buildings and private homes. This has led to the development of a wide variety of commercially available smoke and heat detectors which are battery operated or are connected to the electrical wiring circuit of a building by a permanent wiring connection or by reception in a light socket or other female electrical receptacle.

In general, fire safety experts recommend that smoke alarm detectors be placed near the ceiling of a room and preferably near the center. In older homes, this recommended position is usually occupied by an existing light fixture, and in such cases, removable detector-light combinations of the type shown by U.S. Pat. Nos. 4,694,285 and 4,812,827 to Scripps, 4,717,910 to Scripps et al., and 4,980,672 to Murphy can be threaded into the fixture. In newer homes, there may be no central ceiling fixture in a room, and in such cases, detector alarm devices which incorporate a light fixture have been hard wired into the house circuit and provide a permanently mounted fixture on the ceiling of a room. Since both the permanent and removable detector units incorporate lights, which may be switched on and off by conventional wall switches, such detectors are powered by rechargeable batteries which are charged when the detector light is switched on by a wall switch.

A problem with ceiling mounted detectors powered by rechargeable batteries is that they are difficult to reach and deactivate in the event the alarm is inadvertently triggered by a condition which is not dangerous. For example, cigarette and cooking smoke have the capability to trigger a smoke alarm, as does steam from cooking or a shower, and normally the alarm will remain operative until the alarm triggering condition dissipates. However, it is difficult or impossible, particularly for elderly or infirm persons, to reach ceiling mounted detectors to deactivate an alarm resulting from a false alarm condition.

In the past, attempts have been made to temporarily disable detector alarms in the event that a false alarm condition occurs. U.S. Pat. No. 4,313,110 to Subulak et al. discloses a manually actuated control circuit for temporarily deactivating a smoke alarm and then automatically reactivating the same after a predetermined time delay. However, this device is controlled by a switch activating pull chain which hangs from the detector and which would prove to be unsightly and often difficult to locate at night when attached to a ceiling mounted unit.

U.S. Pat. No. 5,093,651 shows a smoke detector unit having a switch for temporary deactivation of the detector connected on the unit between the battery and the detector component. This switch would be difficult to reach in the case of a ceiling mounted unit.

Finally, U.S. Pat. No. 4,788,530 to Bernier discloses a remote switching device for deactivating a ceiling mounted smoke detector which is affixed to a wall below the detector. This switching device includes a holding relay, a dry cell battery and a time delay circuit, and is connected to the smoke detector by special wiring installed in the wall and ceiling.

Large multistory homes and buildings often have one or more alarm detectors installed on each level, and it is often difficult when an alarm condition occurs on a remote level, for it to be promptly recognized and action taken by persons on other levels. In an attempt to alleviate this problem, U.S. Pat. No. 4,812,827 to Scripps illustrates a detector unit combined with a small radio transmitter which communicates with a second remote detector having a small radio receiver. This system is effective only if the initial alarm condition occurs in the vicinity of the detector with the transmitter. To be even more effective, each detector would have to incorporate both a radio transmitter and a radio receiver, which could prove expensive and result in a bulky and unsightly unit.

Security lighting systems have been developed which utilize the utility power lines of a building to provide communication between a master control transmitting unit and a plurality of remote light receiving units. U.S. Pat. Nos. 5,031,082 to Bierend and 5,072,216 to Grange disclose power line transmitting and receiving systems of this type. Microprocessor transmitters and receivers have also been developed to communicate over the utility power lines of a building to control the operation of an electrical appliance. U.S. Pat. No. 5,189,412 to Mehta et al. discloses a microprocessor control system of this type. Unfortunately, this technology has never been adapted for use with detector sensing systems such as fire, heat and smoke detector.

DISCLOSURE OF THE INVENTION

It is a primary object of the present invention to provide a novel and improved overhead detector and light assembly having an alarm which may be deactivated for a predetermined delay period by operation of a conventional power controlling wall switch for the building electrical circuit without the need for special wiring.

Another object of the present invention is to provide a novel and improved overhead detector and light assembly wherein deactivation of an alarm in a false alarm situation is controlled by a conventional wall switch for the building electrical circuit and the deactivation control circuit is incorporated in the detector.

A further object of the present invention is to provide a novel and improved overhead detector and light assembly wherein deactivation of an alarm in a false alarm situation is controlled by operating a conventional wall switch for the building electrical circuit to provide a deactivation code to the detector. Upon receipt of the deactivation code, the detector will deactivate an alarm circuit for a short period of time and then will reactivate the alarm circuit.

Yet another object of the present invention is to provide a novel and improved overhead detector and light assembly wherein deactivation of an alarm in a false alarm situation is controlled by operating a conventional wall switch for the building electrical circuit to provide a deactivation code to the detector within a predetermined period of time.

Another object of the present invention is to provide a novel and improved overhead detector and light assembly which, when connected to the electrical power lines in a building, will respond to a detected alarm condition and will send a coded activation signal over the power lines to activate the alarms in other detectors sharing the same utility power lines.

A further object of the present invention is to provide a novel and improved overhead detector and light assembly which includes a transmitter-receiver unit which permits the detector to transmit and receive signals over the electrical power lines in a building. The detector may be operated from any room of a house or building which has a standard utility power receptacle and will communicate with similar detectors that share the same utility power lines.

A still further object of the present invention is to provide a novel and improved overhead detector and light assembly which includes a transmitter-receiver unit to permit the detector to transmit and receive signals over the electrical power lines in a building. When the detector senses an alarm condition, it provides an audible and/or visual alarm and transmits signals over the building power lines to activate the alarm in similar detectors sharing the same utility power line. If another of such detectors is activated first in response to an alarm condition, the detector will provide an alarm upon receipt of an activation signal over the building power lines.

BEST MODE FOR CARRYING OUT THE INVENTION

Figure 1:
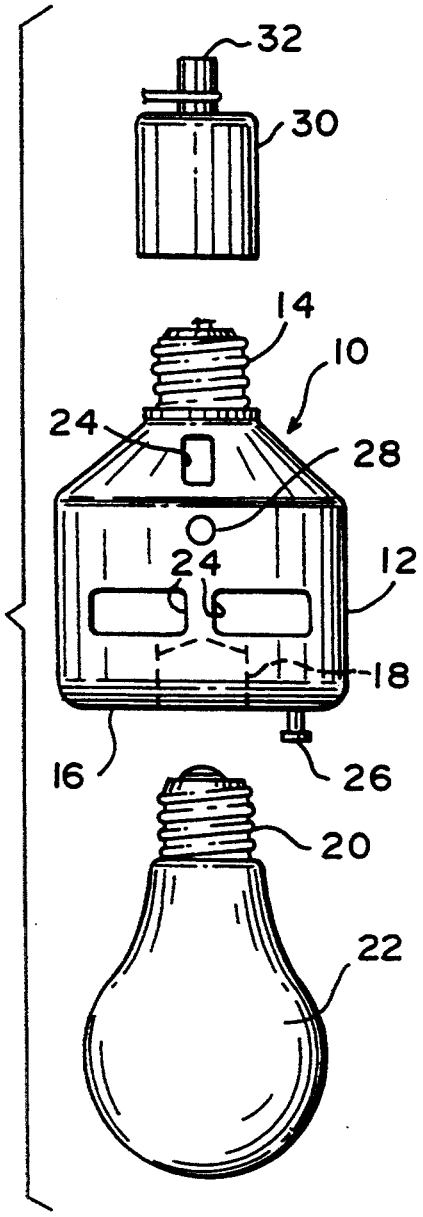
FIG. 1 is an exploded view in side elevation of the overhead detector and light assembly with remote control of the present invention.

A preferred embodiment of the overhead detector and light assembly with remote control of the present invention is indicated generally at 10 in FIG. 1. It is advantageous for the assembly to be removably received in a standard utility power receptacle so that it can be easily installed and removed for repositioning. However, although the invention will be described with reference to a removable detector assembly of this type, it should be understood that the invention may be incorporated in a detector connected in any manner to the electrical power system for a building, such as by hard wiring. Also, for purposes of description, the overhead detector will be referred to as a smoke detector, but it should be understood that the detector can constitute any electrically powered detector such as for heat, gas, radiation, motion, radon or detection of some other condition.

The overhead detector and light assembly 10 includes a housing 12 having a projecting threaded mount and connector assembly 14 which is identical to the base portion of a conventional incandescent light bulb. The wall 16 of the housing opposite to the mount 14 includes a threaded socket 18 which is a unitary part of the threaded mount and connector assembly, and this socket receives the threaded base 20 of light bulb 22. The housing is provided with openings 24 which permit air to circulate through the housing to reach the detector circuitry mounted therein. The condition of the detector battery may be tested by a test button 26, and a LED or other light indicator 28 indicates when house power is being provided to the detector from the building electrical power lines.

When the detector and light assembly 10 is threaded into an overhead socket 30 which is connected to a household electrical power line 32, it will receive household power from the power line under the control of a wall switch (not shown). When power is provided, the light bulb 22 will light and a battery charger in the detector circuit will be powered to charge a detector battery. When no power is received from the power line 32, the detector circuit will be powered from the detector battery.

Figure 2:
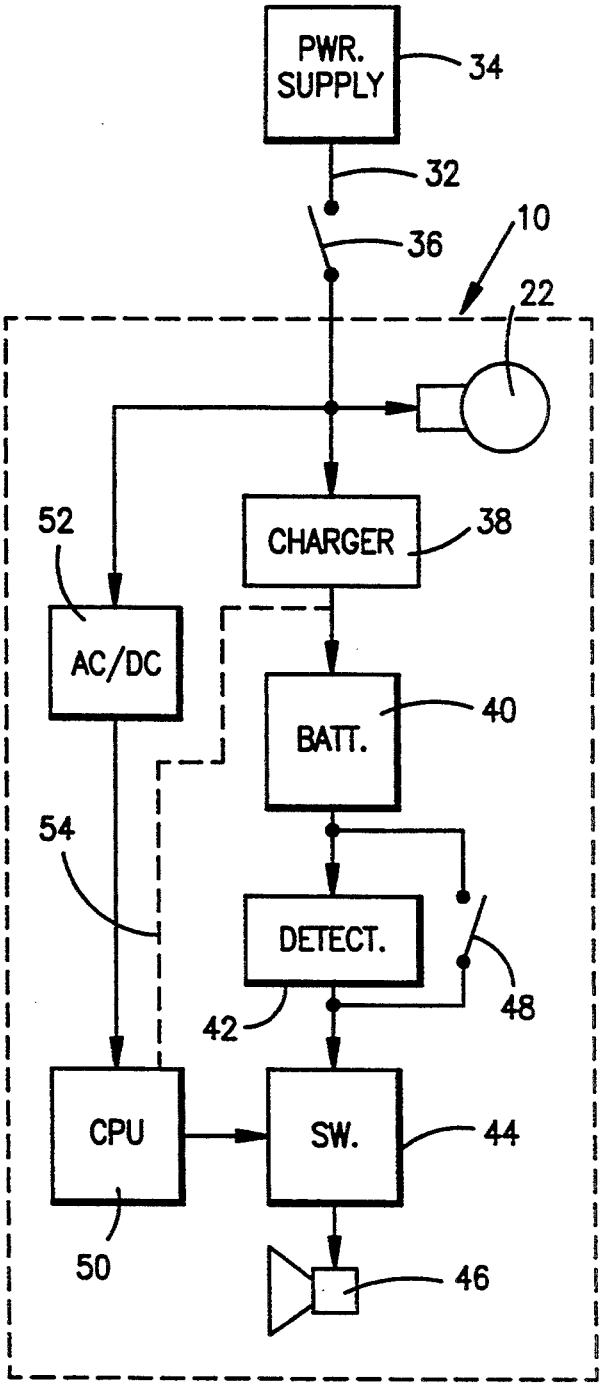
FIG. 2 is a block diagram of the electrical circuit for the overhead detector and light assembly with remote control of the present invention.

FIG. 2 shows the overhead detector and light assembly with remote control 10 connected by the power line 32 to the building power supply 34. A wall switch 36, when closed, energizes the light bulb 22 and provides power to a battery charger 38. The battery charger maintains the charge on a rechargeable battery 40, which provides power to a detector 42. Connected to the detector through a normally closed switch 44 is a horn or similar electrically powered audible alarm unit 46.

Normally, the detector 42 breaks the circuit from the battery 40 to the horn 46, but when the detector detects smoke, heat, gas, movement or some other condition for which an alarm is to be given, the detector closes the circuit to the horn 46 to cause an audible alarm to occur. When the wall switch 36 is open, the light bulb 22 is extinguished, but power to the detector 42 is provided by the battery 40. The battery may be tested by pushing the test button 26 as shown in FIG. 1 to close a switch 48 which completes a short circuit from the battery around the detector to the horn 46.

To this point, the circuit of the assembly 10 is conventional, and in such conventional circuits, if the horn 46 is activated by a condition which is not hazardous, such as cooking smoke, the horn will continue to sound until the smoke dissipates or the battery 40 is removed from the housing 12. In some units, the switch 44 may be manually activated by a pull chain hanging from the ceiling or by a switch button on the casing 12. Neither of these alternatives is desirable, for the pull chain is both unsightly and difficult to find in the dark, while reaching the deactivating switch button on the casing 12 is both difficult and dangerous when the casing is mounted in a ceiling socket.

A preferred solution to the false alarm problem is to control the operation of the switch 44 with a microprocessor 50. The microprocessor is programmed to open the switch 44 for a predetermined delay period upon receipt by the microprocessor of a predetermined number of input pulses within a defined input time. For example, if the microprocessor receives three input pulses within a three second period, it can be programmed to open the switch 44 for, as an example, two minutes before reclosing the switch.

The input pulses to the microprocessor 50 are provided by rapidly closing and opening the wall switch 36. This pulses the house power on the power line 32 to the overhead detector and light assembly with remote control 10, and it is these power transitions between a power on and power off condition which are sensed by the microprocessor 50. For example, the zero power pulses when the wall switch is open may be sensed or the power pulses when the switch is closed may be sensed. It is also possible to sense a combination of zero power pulses and power pulses. When power pulses are among those sensed, these pulses are provided to an AC to DC converter 52 which causes lower voltage DC pulses to be provided to the microprocessor 50. In some cases, the AC to DC converter can be eliminated and the microprocessor input pulses can be provided directly from the output of the battery charger 38 as indicated by the connection shown in broken lines at 54.

It is desirable to have a microprocessor 50 operate in response to a plurality of input pulses created within a short period of time. This will preclude the processor from operating in response to a single closing or a single closing and opening cycle of the wall switch 36, and it is unlikely that momentary disruptions in household power will occur the necessary number of times within the time period required to operate the microprocessor so as to cause the microprocessor to open the switch 44 for the preset delay time. Thus the conventional wall switch can be used effectively without special wiring to terminate a false alarm condition for a preset delay period. If the false alarm condition persists at the end of the delay period, the wall switch can again be manipulated to initiate a new delay period.

Figure 3:
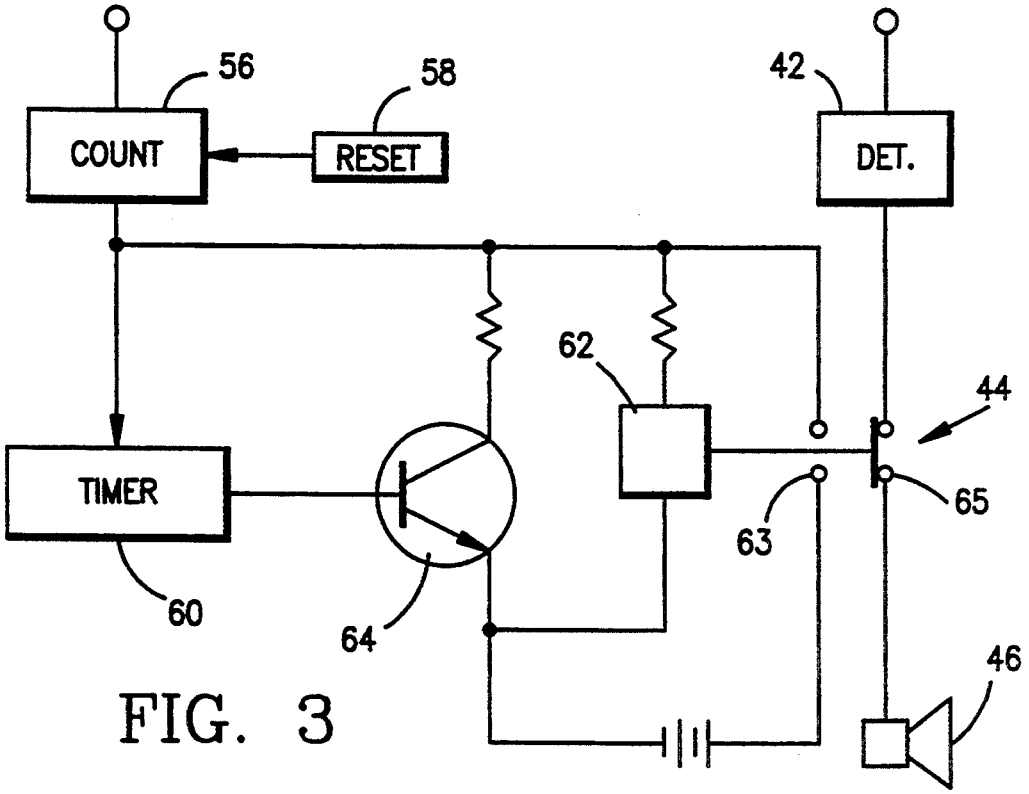
FIG. 3 is a block diagram of the electrical circuit for a second embodiment of the overhead light assembly with remote control of the present invention.

The microprocessor 50 can be replaced by a logic circuit or a counter or timing circuit which will control the timed deactivation of the horn 46 in response to pulses from the wall switch 36. For example, as shown in FIG. 3, the pulses from the charger 38 or the AC to DC converter 52 are applied to a counter 56 having a timed reset circuit 58. If the counter receives the preset number of pulses before being reset, it provides an output signal which operates both to trigger a timer 60 and to open the switch 44. In this case, the switch 44 is a latching relay that includes a coil 62 which, when energized, holds a relay switch against contacts 63 until the coil is shunted by conduction of a transistor 64. This conduction of the transistor is initiated by the timer 60 at a predetermined time after the timer is triggered, and deenergizes the relay coil so that the switch moves back to its normal position across contacts 65 to reconnect the horn 46 to the detector 42. In this circuit, the counter 56 and timed reset circuit 58 can be replaced by a one shot multivibrator circuit which operates upon receipt of a preset number of input pulses within a specified time to provide an output to the timer 60 and switch 44.

Figure 4:
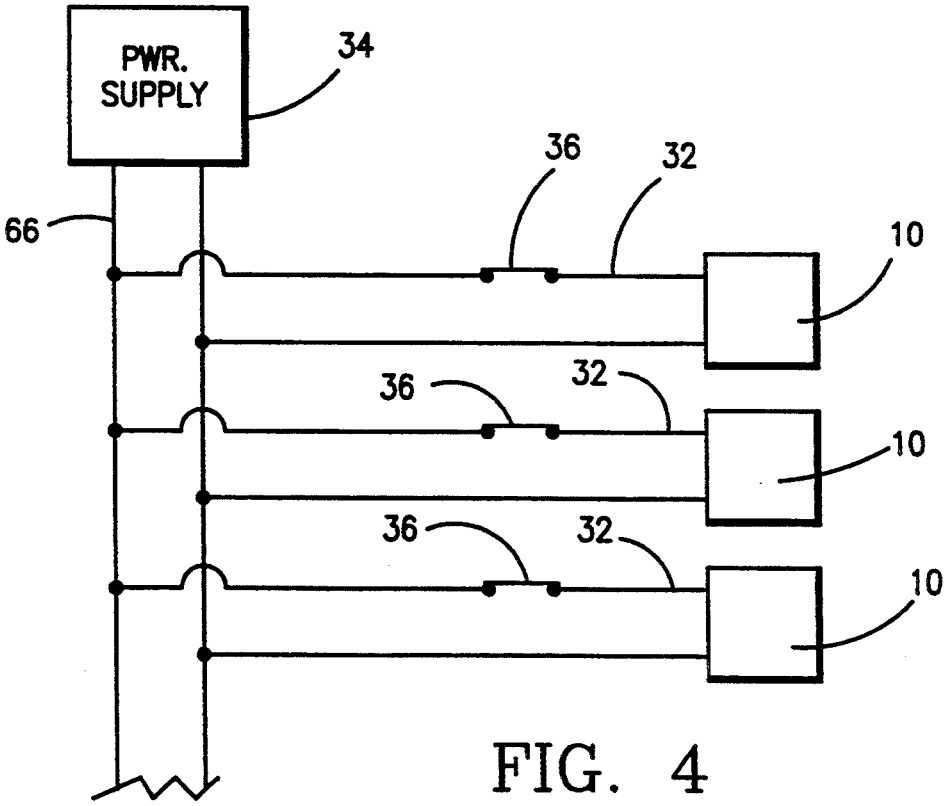
FIG. 4 is a block diagram of a plurality of overhead light assemblies with remote control connected to a common utility power line.

Referring now to FIG. 4, it will be noted that a plurality of overhead detector and light assembly with remote control units 10 may be connected to a common utility power line 66. When one of these units detects a dangerous condition and initiates an audible alarm, it would be beneficial to have the remaining units also initiate an alarm before the dangerous condition is actually sensed by them. This can be accomplished with the circuit of FIG. 5 wherein a transmitter microprocessor 68 replaces the microprocessor 50. The transmitter microprocessor operates in the same manner as the microprocessor 50 to respond to a DC coded signal from the charger 38 triggered by the switch 36 to open the switch 44 for a predetermined delay period.

The transmitter microprocessor 68 is also programmed in a known manner to send coded signals over the common utility power line 66 to other overhead detector and light assembly with remote control units connected to the same power line. Upon receipt of an input signal on an input line 70 which lasts for more than a predetermined time period, i.e., thirty seconds, the transmitter microprocessor will send a coded horn actuation signal modulated over the 60 Hz AC power signal on the power lines 32 and 66 to other overhead detector and light assembly with remote control units connected to the power line. This coded horn actuation signal is delayed after the initial activation of the horn 46 so that the signal will not be sent in response to a momentary closure of the switch 48. Also, the delay provides a short period during which the wall switch 36 can be actuated to shut off the horn in a false alarm situation.

The delay period is preferably programmed into the transmitter microprocessor 68, but obviously a signal delay circuit could be connected to the input line 70 to delay the input signal from the horn power circuit to the transmitter microprocessor.

Once the delay period expires and the signal from the horn power circuit is still present on the input line 70, the transmitter microprocessor will send a horn activation code to other units on the common utility power line 66. This code is received by an AC decoder 72 along with the 60 Hz AC power signal, and the decoder decodes the code modulated on the power signal and transmits the decoded signals to a receiver microprocessor 74. In response to the decoded horn activation signals, the receiver microprocessor closes a normally open switch 76 to shunt the detector 42 and actuate the horn 46. The horn 46 will remain activated in response to receipt by the receiver microprocessor of a horn activation signal until a horn terminate coded signal is sent over the power line 66 by the transmitter microprocessor 68. Of course, the horn can be temporarily deactivated by operation of the wall switch 36, but after the delay period, the horn will be reactivated if the horn terminate coded signal has not been received by the receiver microprocessor 74.

It is important to require units having horns which have been activated by a coded horn activation signal to receive a coded horn termination signal before they can be permanently turned off without removal of the battery 40. This requires someone to find and check the conditions in the area of the original transmitting unit before turning it off, or for the condition which triggered the horn in the original transmitting unit to dissipate. Only then will the horn terminate code be sent by the transmitting microprocessor 68 in response to the absence of an input signal on the input line 70. This prevents someone from easily turning off the remote units will, out checking for the alarm condition which triggered the original transmitting unit.

When the overhead detector units 10 of FIG. 4 include a light 22, it is preferable to be able to switch the lights off while maintaining the wall switches closed so that the units can communicate over the power line 66. For this purpose, each unit is provided with a light switch 78 which may constitute a manually activated switch connected to open the circuit to the light 22. When the wall switch 36 is closed and the light switch 78 is open, the light switch completes a circuit to the LED 28 to indicate that the wall switch has connected the unit 10 to the power line 66.

Ideally, the light switch 78 can be activated by the microprocessor 68 in the same manner as the horn switch 44. For example, the wall switch might be opened and closed three times to open the horn switch for a delay period, four times to open the light switch 78 and five times to close the light switch. When this code is used, the horn switch will be opened each time the light switch 78 is operated by the transmitter microprocessor 68, but only for the short preset delay period and then the horn switch will automatically reclose. To prevent this, the microprocessor 68 may operate the horn switch in response to zero power pulses and the light switch in response to power pulses or vice versa.

Figure 5:
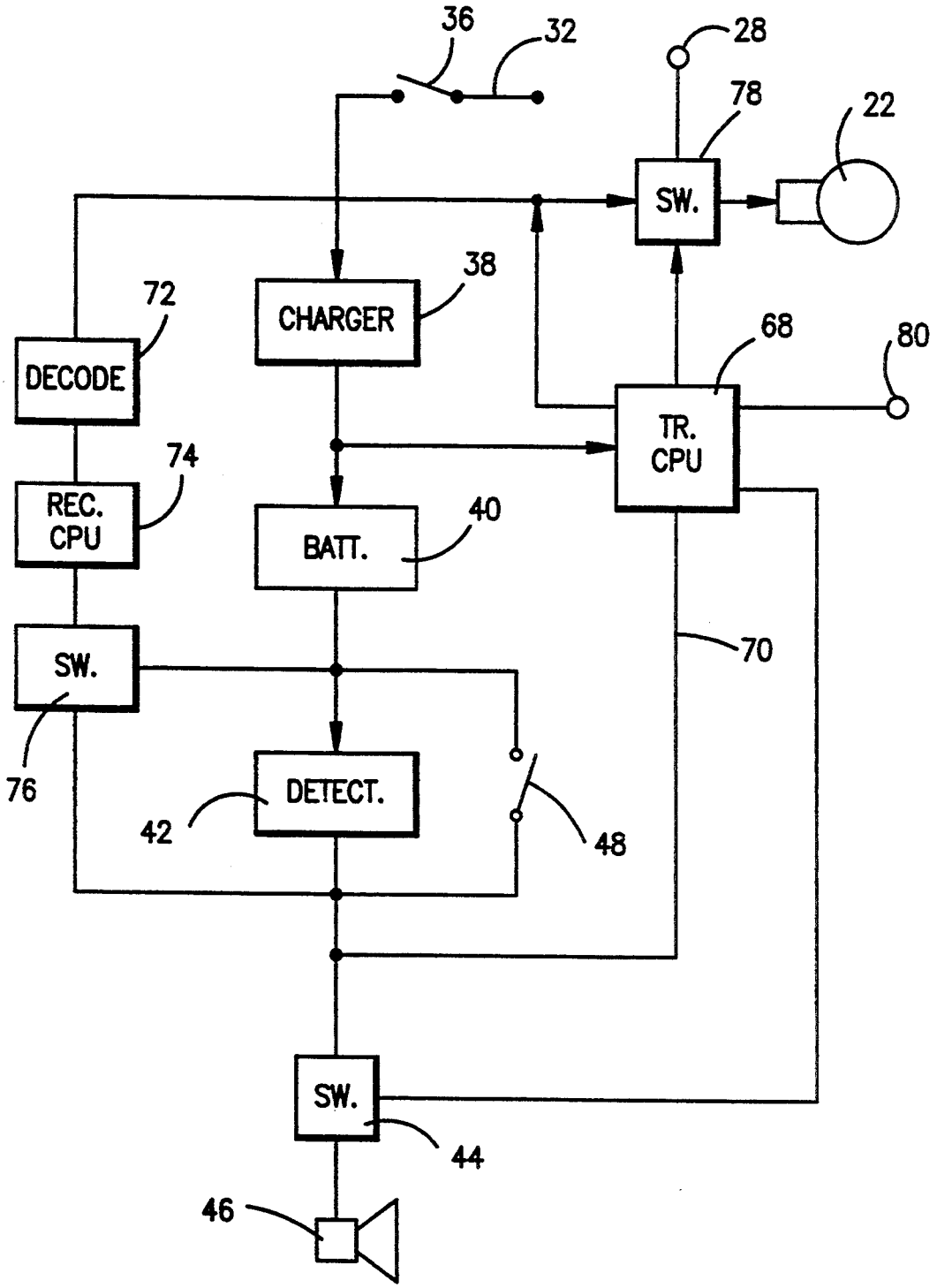
FIG. 5 is a block diagram of a third embodiment of the electrical circuit for the overhead detector and light assembly with remote control of the present invention.

In FIG. 5, the overhead detector and light assembly 10 is shown with both a transmitter microprocessor 68 and a receiver microprocessor 74, and ideally, each assembly will have this capability to transmit and receive. However, for some applications, the most remote unit 10 could be provided with only a transmitting capability, thus eliminating the decoder 72 and the receiver microprocessor 74, while the remaining units might include only the decoder 72 and receiver microprocessor 74. For these applications, if microprocessor control of the horn switch 44 and/or the light switch 78 is required, these functions would be performed by the receiver microprocessor.

The transmitter and receiver microprocessors may be any one of a number of microprocessors known to the art. In some cases, both the transmitting and receiving function can be performed by a single microprocessor which may also be programmed to control the horn switch 44 and the light switch 78. To aid in identifying the overhead detector and light assembly 10 which is the transmitting unit originally activated by an alarm condition, the transmitting microprocessor 68 is programmed to provide an output indication, such as the illumination of a red LED 80, when the activation code is transmitted over the power lines 32 and 66. This LED would be extinguished when the input signal no longer appears on the input line 70.

Figure 6:
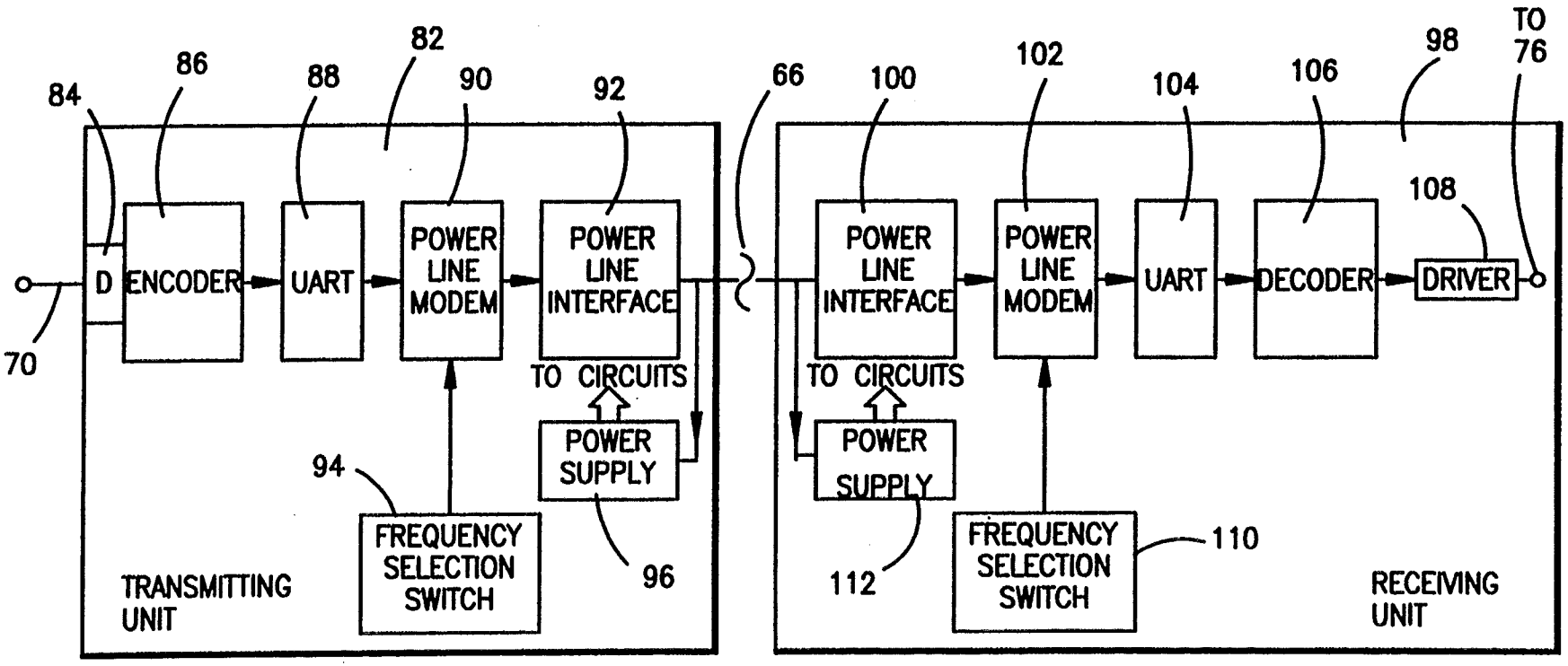
FIG. 6 is a block diagram of a fourth embodiment of the electrical circuit for the overhead detector and light assembly of the present invention.

A number of known circuits can be incorporated into the detector portion of the overhead detector and light assembly with remote control 10 to cause a code to be transmitted over the power line 66 when one assembly is activated to activate the alarm horns for other assemblies on the power line. FIG. 6 illustrates one of these known circuits which can be substituted for the transmitter microprocessor 68, the decoder 72 and the receiver microprocessor 74. This circuit can be used in an assembly where microprocessor control of the light switch 78 is not required and the horn switch 44 is either controlled by a circuit such as that in FIG. 3 or is eliminated.

The transmitter microprocessor 68 is replaced by a transmitting unit 82 having an input line 70 connected to sense the horn activating signal from the detector 42. A delay circuit 84 is provided to delay the signal on the line 70 so that momentary operation of the switch 48 will not provide an input signal to the transmitting unit.

The transmitting unit 82 includes an encoder 86 which operates in response to an input on the line 70 to provide a horn activation code in the form encoded digital signals to a universal asynchronous receiver/-transmitter 88. A horn deactivation code is provided in a similar manner once the input on the line 70 is removed. The receiver/transmitter 88 converts the signal from the encoder into a digital serial format and applies it to a power line modem 90, which in turn converts the digital serial signal into a modulated signal for transmission over the power line 66 by means of a power line interface circuit 92. The modulated signal consists of an amplified shift key carrier on/off modulated signal where for a one bit, the modem outputs the carrier frequency while for a zero bit the modem sends no signal. A frequency selector switch 94 connected to the power line modem selects one of a plurality of operational frequencies for the transmitting unit, and a power supply 96 connected to the power lines 32–66 converts the power line AC voltage to a DC voltage suitable for powering the components of the transmitting unit 82.

The decoder 72 and receiver microprocessor 74 may be replaced by the receiving unit 98 of FIG. 6 which includes a power line interface 100 to receive and process the modulated signal from the power line 66. The power line interface 100 couples the received signal to a power line modem 102 while preventing any relatively high voltage on the power line 66 from entering the receiving unit. The power line modem 102 converts the received modulated signal back to a digital serial data format and provides this digital serial data to a universal asynchronous receiver/transmitter 104. The output from the receiver/transmitter 104 is applied to a decoder 106 which converts the digital code to a control signal for a switch driver 108. This switch driver in turn operates the switch 76 to complete a shunt circuit around the detector 42 to energize the horn 44 until a horn terminate signal is received by the receiving unit 98.

A receiver frequency selector switch 110 sets the same operational frequency for the receiving unit 98 as that set by the frequency selector switch 94 for the transmitting unit 82, and a receiver power supply 112 operates in the same manner as the power supply 96 to supply DC power to the components of the receiving unit.

As in the case of the transmitter and receiver microprocessors 68 and 74 of FIG. 5, each overhead detector and light assembly with remote control unit 10 may include both a transmitting unit 82 and a receiving unit 98, or alternatively, the transmitting unit may be located in the most remote unit 10 with the remaining units 10 connected to the power line 66 having only a receiving unit.

INDUSTRIAL APPLICABILITY

The overhead detector and light assembly with remote control 10 may be connected to the common utility power line of a building by hard wiring or by installation in an electrical socket connected to the utility power line. The unit will activate similar units connected to the same power line by sending an activation code over the power line, and includes an alarm circuit which can be deactivated for a predetermined delay time by the operation of a conventional wall switch connected to the power line.

I claim:

1. A detector assembly adapted to be connected to a building power supply system which includes a power supply line and a power control switch connected to said power supply line to control power transitions in power supplied to a unit connected to said power supply line, said power control switch operating an open position to cause a power-off condition and prevent power on said power supply line from reaching said detector assembly connected thereto and in a closed position to cause a power-on condition wherein power on said power supply line is permitted to reach said detector assembly, said detector assembly comprising:

a power terminal connectable to said power supply to receive power therefrom;

electrically powered alarm circuit means operable when activated to provide an alarm;

detector means connected to said alarm circuit means and operating to sense said alarm condition, said detector means operating in response to an alarm condition sensed thereby to provide electrical power to activate said alarm circuit means;

alarm control switch means connected between said detector means and said alarm circuit means to control the provision of electrical power from said detector means to said alarm circuit means, said alarm control switch means operating in a normal condition to permit electrical power to pass from said detector means to said alarm circuit means and operable in a blocking condition to prevent such electrical power from reaching said alarm circuit means;

and code responsive control means connected to said power terminal and said alarm control switch means and operating to control said alarm control switch means, said code responsive control means operating in response to a plurality of power transitions at said power terminal caused by said power control switch between a power-on and power-off condition constituting an activation code to cause said alarm control switch means to operate in said blocking condition.

2. The detector assembly of claim 1 wherein said code responsive control means operates to cause said alarm control switch means to operate in said blocking condition for a predetermined time interval and to then return to said normal condition.

3. The detector assembly of claim 2 wherein said power terminal includes a male electrical connector means which operates to removably secure said detector assembly to a female electrical receptacle connected to said power supply line.

4. The detector assembly of claim 3 which includes a housing which encloses said electrically powered alarm circuit means, detector means, alarm control switch means and code responsive control means, said male electrical connector means extending outwardly from said housing to form the sole mounting support for said housing.

5. The detector assembly of claim 1 wherein said code responsive control means is responsive to a preset number of power transitions occurring within a predetermined time period to cause said alarm control switch means to operate in said blocking condition.

6. The detector assembly of claim 5 wherein said code responsive control means operates to cause said alarm control switch means to operate in said blocking condition for a predetermined time interval and to then return to said normal condition.

7. The detector assembly of claim 1 which incudes a battery, said detector means and alarm control switch means being connected in an electrical circuit between said battery and said electrically powered alarm circuit means.

8. The detector assembly of claim 7 which includes a battery charger means connected to receive power from said power terminal, said battery charger means being connected to said battery and operating to provide charging power to said battery.

9. The detector assembly of claim 1 which includes code transmitter means connected to said power terminal and operative to sense the activation of said electrically powered alarm circuit means, said code transmitter means operating upon the activation of said electrically powered alarm circuit means to transmit an activation code signal to said power terminal for transmission over said power supply line.

10. The detector assembly of claim 9 which includes detector power supply means connected to supply electrical power to said detector means, and code activated circuit means connected between said power supply means and said electrically powered alarm circuit means; said code activated circuit means including a power control switching means operable to normally open the code activated circuit means to prevent electrical power from the detector power supply means from being provided to said electrically powered alarm circuit means through said code activated circuit means, and code receiver means connected to said power terminal and operative to receive therefrom an activation code transmitted over said power supply line, said code receiver means being connected to said power control switching means and operating upon receipt of said activation code to cause said power switching means to close the code activated circuit means to provide electrical power from said detector power supply means to said electrically powered alarm circuit means.

11. The detector assembly of claim 1 which includes detector power supply means connected to supply electrical power to said detector means, and code activated circuit means connected between said power supply means and said electrically powered alarm circuit means; said code activated circuit means including a power control switching means operable to normally open the code activated circuit means to prevent electrical power from the detector power supply means from being provided to said electrically powered alarm circuit means through said code activated circuit means, and code receiver means connected to said power terminal and operative to receive therefrom an activation code transmitted over said power supply line, said code receiver means being connected to said power control switching means and operating upon receipt of said activation code to cause said power switching means to close the code activated circuit means to provide electrical power from said detector power supply means to said electrically powered alarm circuit means.

12. A detector assembly adapted to be connected to a building power supply system which includes an electrical power supply line, comprising:

a power terminal connectable to said power supply line to complete an electrical connection therewith;

electrically powered alarm circuit means operable when activated to provide an alarm;

detector means connected to said alarm circuit means and operating to sense an alarm condition, said detector means operating in response to said alarm condition sensed thereby to provide electrical power to activate said alarm circuit means; and code transmitter means connected to said power terminal and operative to sense the activation of said electrically powered alarm circuit means and operating after the activation of said electrically powered alarm circuit means to transmit an activation code signal to said power terminal for transmission over said power supply line and upon the subsequent termination of the provision of electrical power to said electrically powered alarm circuit means to transmit a deactivation code to said power terminal for transmission over said power supply line, said code transmitter means operating to delay the transmission of said activation code for a predetermined delay period after the activation of said electrically powered alarm circuit means and to transmit said activation code if said electrically powered alarm circuit means remains activated after said predetermined delay period.

13. The detector of claim 12 wherein said code transmitter means delays the transmission of said activation code for a predetermined delay period alter the activation of said electrically powered alarm circuit means, said code transmitter means operating to transmit said activation code if said electrically powered alarm circuit means remains activated after said predetermined delay period.

14. The detector assembly of claim 13 wherein said code transmitter means transmits a deactivation code to said power terminal for transmission over said power supply line upon the termination of the provision of electrical power to said electrically powered alarm circuit means.

15. The detector assembly of claim 12 which includes light bulb receiving socket means operative to receive and provide power to an electric light bulb, light power circuit means connected between said light bulb receiving socket and said power terminal to provide an electrical circuit therebetween, said light power circuit means including switching means operable to complete or break the electrical circuit between said light bulb receiving socket and said power terminal.

16. A detector assembly adapted to be connected to a building power supply system which includes a power supply line and a power control switch connected to said power supply line to control power transitions in the power supplied to a unit connected to said power supply line, said power control switch operating in an open position to cause a power-off condition and prevent power on said power supply line from reaching said detector assembly connected thereto and in a closed position to cause a power-on condition wherein power on said power supply line is permitted to reach said detector assembly, said detector assembly comprising:

a power terminal connectable to said power supply line to receive power therefrom;

electrically powered alarm circuit means operable when activated to provide an alarm;

detector means connected to said alarm circuit means and operating to sense an alarm condition, said detector means operating in response to said alarm condition sensed thereby to provide electrical power to activate said alarm circuit means;

a light bulb receiving socket means operative to receive and provide power to an electric light bulb;

light power circuit means connected between said light bulb receiving socket and said power terminal to provide an electrical circuit therebetween, said light power circuit means including light switching means operable to complete or break the electrical circuit between said light bulb receiving socket and said power terminal;

and code responsive control means connected to said power terminal and said light switching means and operative to control said light switching means, said code responsive control means operating in response to a first plurality of power transitions at said power terminal caused by said power control switch between a power-on and power-off condition constituting an activation code to cause said light switching means to break the electrical circuit between said light bulb receiving socket and said power terminal.

17. The detector assembly of claim 16 wherein said code responsive control means operates in response to a second plurality of power transitions of a number different from said first plurality of power transitions to cause said light switching means to complete the electrical circuit between said light bulb receiving socket and said power terminal.

18. The detector assembly of claim 17 which includes code transmitter means connected to said power terminal and operative to sense the activation of said electrically powered alarm circuit means, said code transmitter means operating upon the activation of said electrically powered alarm circuit means to transmit an activation code signal to said power terminal for transmission over said power supply line.

19. The detector assembly of claim 17 which includes detector power supply means connected to supply electrical power to said detector means, and code activated circuit means connected between said power supply means and said electrically powered alarm circuit means; said code activated circuit means including a power control switching means operable to normally open the code activated circuit means to prevent electrical power from the detector power supply means from being provided to said electrically powered alarm circuit means through said code activated circuit means, and code receiver means connected to said power terminal and operative to receive therefrom an activation code transmitted over said power supply line, said code receiver means being connected to said power control switching means and operating upon receipt of said activation code to cause said power switching means to close the code activated circuit means to provide electrical power from said detector power supply means to said electrically powered alarm circuit means.

20. A detector assembly adapted to be connected to a building AC power supply system which includes an electrical power supply line, comprising:

a power terminal connectable to said power supply line to complete an electrical connection therewith;

a detector DC power supply means;

electrically powered alarm circuit means operable when activated to provide an alarm;

detector means connected between said detector power supply means and said alarm circuit means and operating to sense an alarm condition, said detector means operating in response to said alarm condition sensed thereby to provide electrical power to actuate said alarm circuit means, code activated circuit means connected in parallel relative to said detector means between said detector power supply means and said electrically powered alarm circuit means, said code activated circuit means including a power control switching means operable to normally open the code activated circuit means to prevent electrical power from the detector power supply means from being provided to said electrically powered alarm circuit means through said code activated circuit means, and code receiver means connected to said power terminal and operative to receive therefrom an activation code transmitted over said power supply line, said code receiver means being connected to said power control switching means and operating upon receipt of said activation code to cause said power control switching means to close the code activated circuit means to provide electrical power from said detector power supply means to said electrically powered alarm circuit means.

21. The detector assembly of claim 20 which includes light bulb receiving socket means operative to receive and provide power to an electric light bulb, light power circuit means connected between said light bulb receiving socket and said power terminal to provide an electrical circuit therebetween, said light power circuit means including switching means operable to complete or break the electrical circuit between said light bulb receiving socket and said power terminal.

22. The detector assembly of claim 20 wherein said detector power supply means includes a battery charger connected to said power terminal and a battery connected to said battery charger and to said detector means and said code activated circuit means.

23. The detector assembly of claim 20 which includes code transmitter means connected to said power terminal and to said electrically powered alarm circuit means and operative to sense the activation of said electrically powered alarm circuit means, said code transmitter means operating in response to the activation of said electrically powered alarm circuit means to transmit an activation code signal to said power terminal for transmission over said power supply line.

24. A detector assembly adapted to be connected to a building power supply system which includes an electrical power supply line, comprising:

a power terminal connectable to said power supply line to complete an electrical connection therewith;

electrically powered alarm circuit means operable when activated to provide an alarm;

detector means connected between said power terminal and said alarm circuit means and operating to sense an alarm condition, said detector means operating in response to said alarm condition sensed thereby to provide electrical power to actuate said alarm circuit means;

code activated circuit means connected in parallel relative to said detector means between said power terminal and said electrically powered alarm circuit means to selectively provide electrical power to said electrically powered alarm circuit means, said code activated circuit means including a power control switching means operable to normally open the code activated circuit means to prevent electrical power from being provided to said electrically powered alarm circuit means through said code activated circuit means, and code receiver means connected to said power terminal and operative to receive therefrom an activation code transmitted over said power supply line, said code receiver means being connected to said power control switching means and operating upon receipt of said activation code to cause said power control switching means to close the code activated circuit means to provide electrical power to said electrically powered alarm circuit means.

25. The detector assembly of claim 24 which includes code transmitter means connected to said power terminal and to said electrically powered alarm circuit means and operative to sense the activation of said electrically powered alarm circuit means, said code transmitter means operating in response to the activation of said electrically powered alarm circuit means to transmit an activation code signal to said power terminal for transmission over said power supply line.

* * * * *